United States Patent [19]

Bullard

[11] Patent Number: 5,027,797

[45] Date of Patent: Jul. 2, 1991

[54] APPARATUS FOR THE MOVEMENT OF BLOOD BY EXTERNAL PRESSURE

[76] Inventor: Horace Bullard, 3333 Henry Hudson Pky., Riverdale, N.Y. 10463

[21] Appl. No.: 420,174

[22] Filed: Oct. 12, 1989

[51] Int. Cl.[5] ..... A61H 1/00; A61H 9/00

[52] U.S. Cl. ..... 128/64; 128/24 R; 128/33; 128/70

[58] Field of Search ..... 128/24 R, 64, 32, 33, 128/44, 70, DIG. 20

[56] References Cited

U.S. PATENT DOCUMENTS

| | | | |
|---|---|---|---|
| 1,608,239 | 11/1926 | Rosett | 128/44 |
| 2,062,299 | 12/1936 | Erickson | 128/33 X |
| 3,303,841 | 2/1967 | Dennis | 128/24 R |
| 3,783,859 | 1/1974 | Sauer et al. | 128/24 R |
| 3,892,229 | 7/1975 | Taylor et al. | 128/64 X |
| 4,565,188 | 1/1986 | Hardie | 128/33 X |
| 4,624,244 | 11/1986 | Taheri | 128/24 R |
| 4,738,249 | 4/1988 | Linman et al. | 128/64 X |
| 4,865,020 | 9/1989 | Bullard | 128/64 |

*Primary Examiner*—Edgar S. Burr
*Assistant Examiner*—Moshe I. Cohen
*Attorney, Agent, or Firm*—Eliot S. Gerber

[57] ABSTRACT

A program of regular vascular exercise involves repeating cycles of blood movement obtained by seating the user in the base portion of the apparatus and clamping a top member shell to the base portion. Under the user's control pressurizing apparatus, controlled by a microcomputer based timing arrangement, inflates and deflates a series of pressure cuffs around each limb to provide a peristaltic-like action which forces blood toward the trunk of the body.

21 Claims, 2 Drawing Sheets

APPARATUS FOR THE MOVEMENT OF BLOOD BY EXTERNAL PRESSURE

BACKGROUND OF THE INVENTION

1. Field of the Invention

The present invention relates to methods and apparatus for vascular exercise by temporarily increasing the amount of blood in the trunk portion of a human body.

2. Description of the Related Art

Massaging of parts of the human body by a mechanical apparatus is shown, for example, in U.S. Pat. No. 3,908,642 for "Means for Aerating and Applying Air Pulsations Within Cast", which describes an arrangement of diaphragms or bladders that is installed within a cast. A series of patents show inflation of tubular bladders placed on a limb to move blood toward the head. These patents include: U.S. Pat. No. 4,338,923 entitled "Inflatable-Cell Type Body Treading Apparatus", to Gelfer et al; U.S. Pat. No. 3,811,431 entitled "Programmed Venous Assist Pump", to Apstein; U.S. Pat. No. 4,311,135 entitled "Apparatus to Assist Leg Venous and Skin circulation", to Brueckner et al; and U.S. Pat. No. 4,013,069 entitled "Sequential Intermittent Compression Device", to Hasty.

Other patents showing the use of air inflated bags on the human body include: U.S. Pat. No. 3,880,149 to Kawaguchi entitled "Blood Circulation Stimulating Apparatus"; U.S. Pat. No. 3,659,593 to Vail, entitled "Cardiovascular Assist Device"; U.S. Pat. No. 3,866,604 to Curless et al, entitled "External Cardiac Assistance"; and U.S. Pat. No. 3,179,106 to Meredith, entitled "Method and Apparatus For Preventing Venous Blood Clotting".

The present invention provides an apparatus and method to improve blood movement, i.e., a vascular system exerciser, which is believed to be equal or superior in its beneficial effect to the vascular exercise obtained from vigorous exercise such as jogging; and which may be used by infirm or elderly persons. It is believed that increasing the amount of blood in the trunk of the body and holding the blood under pressure in the trunk and also, optionally, simultaneously applying pulsed pressure at the buttock area, can yield beneficial results. There are indications that the beneficial results include an improved capillary circulation, as shown by improved skin tone and improved functioning of the liver and lymph systems. In addition, it may be considered that the system and method of the present invention may be useful in those conditions in which there is inadequate blood circulation, including Alzheimer's disease (lack of brain blood circulation), kidney malfunctions, and blood capillary circulatory problems, such as loss of hair color and loss of hair growth, collapsed or narrowed veins, and arteriosclerosis.

SUMMARY OF THE INVENTION

In accordance with the invention, there is provided apparatus comprising, in combination, pressure applying means (cuffs or bladders) which is applied around all four limbs of a person and at the buttock area.

The patient, without the aid of others, may sit down in the apparatus, adjust its size to his/her needs, set the timers, and commence the blood exercise program. The apparatus includes a base member in which the person sits, and a top member which he swings down on the base member. Actuating means coupled to the four limb pressure applying means controls the timing and the pressure. Each of the four limb pressure applying means has differentially actuatable sections, preferably inflatable cuffs, which are applied to a limb in an array extending along the limb. The actuating means has sequencing means for activating the limb sections to constrict each limb in a peristaltic-like sequence from the section nearest the limb extremity to the section nearest the trunk, forcing the blood toward the heart.

The following procedure is followed, preferably at least 4–6 weeks and preferably, like exercise, on a daily schedule for about one hour each day. Preferably, first each of the legs is placed under pressure, in sequence, and then each of the arms is placed under pressure, in sequence, and the pressure is held on all four limbs for at least 20 seconds, and less than 120 seconds. The buttock muscle exerciser bladder is pulsed with air pressure, preferably in another separate procedure as part of each cycle, while the pressure is held on all the limbs. Then the pressure is released. After 30 seconds to 60 seconds, the pressure is re-applied in the same sequence. This is repeated for 5–30 cycles, and preferably 20 cycles. The pressure is applied so that blood is placed under pressure in the trunk for 5 to 30 times each day.

In addition, preferably in another separate procedure as part of each cycle, for example, three of the bladders of each of the arms and legs are operated in the reverse direction with peristaltic-like sequence starting at the section nearest the trunk and progressing outwardly. For example, first the arm pressure applying means are so operated, in sequence, to force the blood toward the hand, and held for at least 20 seconds and less than 120 seconds. Next the leg pressure applying means are operated, in sequence, to force blood toward the feet and the pressure held for 20–120 seconds.

This invention relates to the inventor's prior U.S. Pat. No. 4,865,020, incorporated by reference herein.

BRIEF DESCRIPTION OF THE DRAWINGS

The invention will be better understood after reading the following detailed description of the presently preferred embodiments thereof with reference to the accompanying drawings, in which:

FIG. 4 is a top plan view of the apparatus of FIG. 2;

FIG. 5 is a side plan view of a prototype of the apparatus of the present invention;

FIG. 6 is a top plan view of the apparatus of FIG. 5;

FIG. 7 is a side view, partly in plan and partly in cross-section, of the apparatus of FIG. 5;

FIG. 8 is a cross-sectional view taken along lines A—A of FIG. 5; and

FIG. 9 is a block diagram of the control mechanism of the present invention.

DETAILED DESCRIPTION OF THE PREFERRED EMBODIMENTS

Figure 1A:
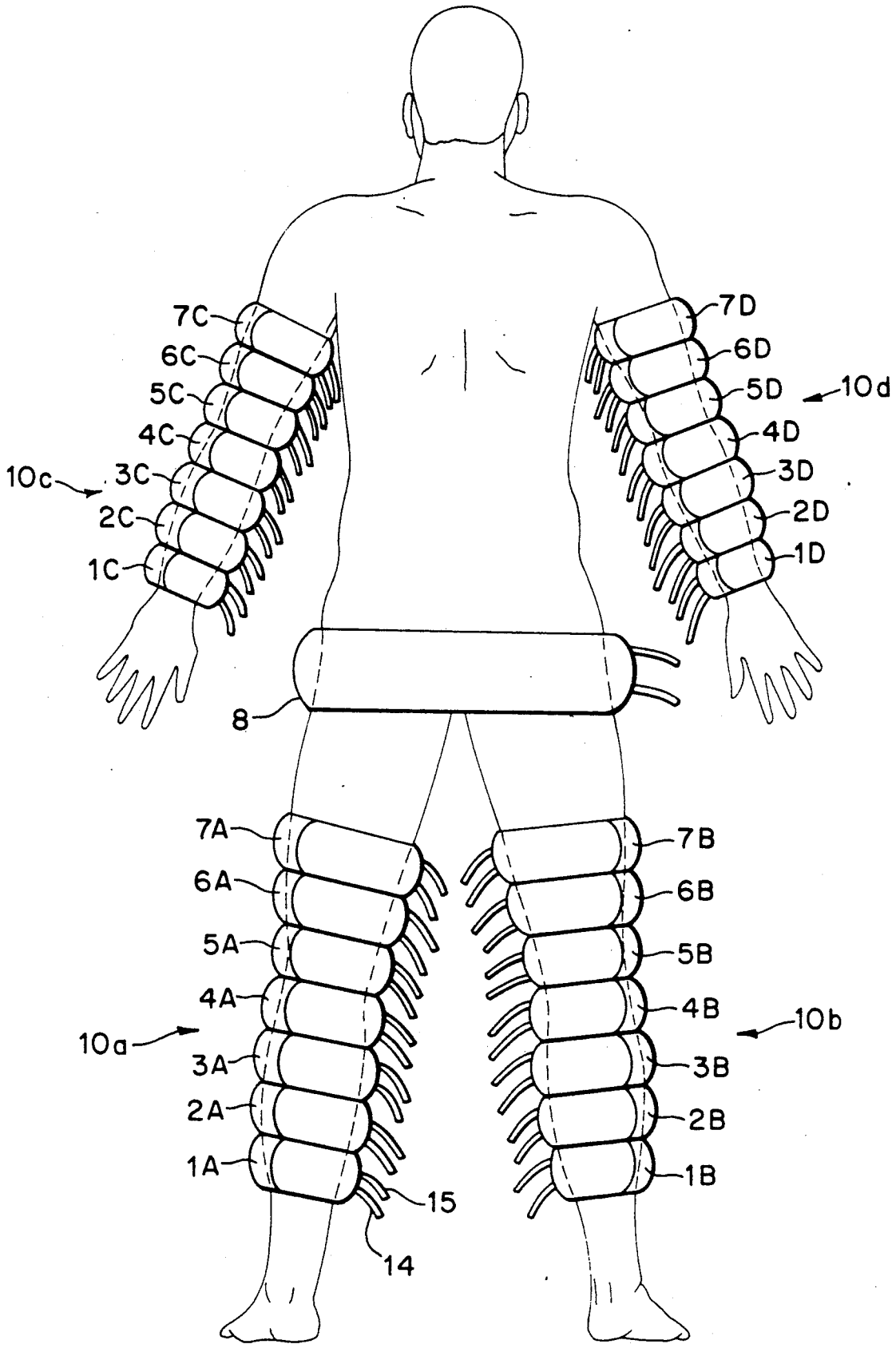
FIG. 1A is an illustration of the present invention applied to the legs and arms of a human.
Figure 2:
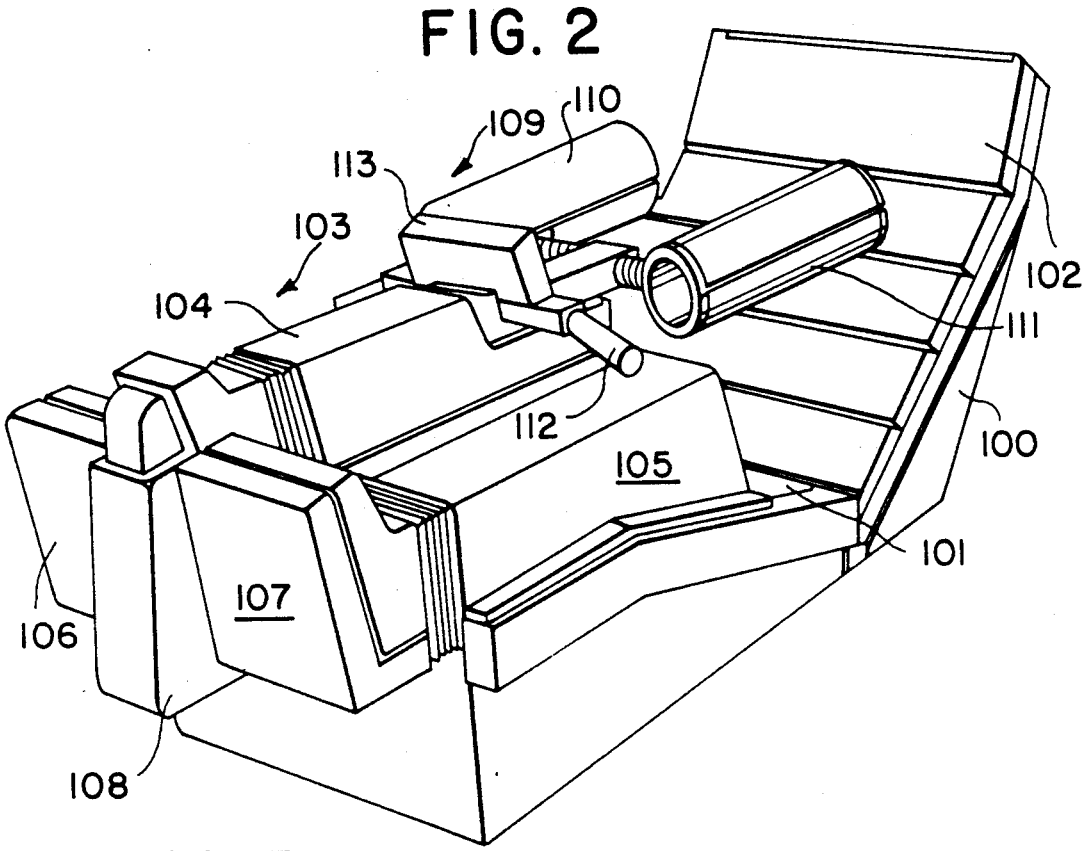
FIG. 2 is a perspective view of the apparatus of the present invention.
Figure 3:
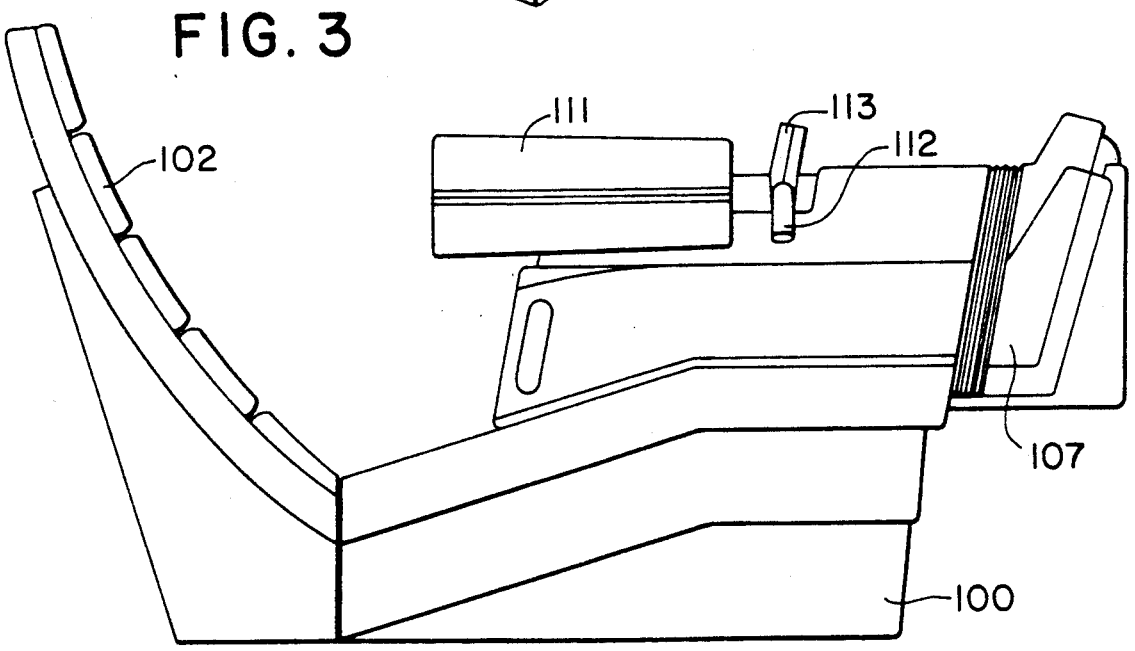
FIG. 3 is a side plan view of the apparatus of FIG. 2.

As shown in FIG. 1A, four groups of pressure cuffs **10*a*–10*d* are applied to all four limbs of a person. The group of cuffs 10*a*, 10*b* are applied to the left and right legs, respectively, and the group of cuffs 10*c*, 10*d* are applied to the left and right arms, respectively. In the embodiment of FIG. 1A** each group of cuffs is not separated into two sets.

In addition, a large inflatable cuff (buttock exerciser) 8 is removably attached at the area of the buttocks. After the leg and arm cuffs are inflated, as explained below, causing the flow of blood toward the trunk and head of the body, their pressure is maintained for at least 20 seconds and preferably less than 60 seconds. At that time, while the pressure is maintained in the arm and leg cuffs, the buttock cuff 8 is inflated and pulsed with preferably 1–3 seconds on and off in repeated cycles, to provide cycles of pressure at the buttock area.

Although no further illustration of the pressure cuffs has been included, it is to be understood that each of the cuffs, identified by the numbers 1A to 7A, 1B to 7B, 1C to 7C and 1D to 7D, is similar to a sphygmomanometric cuff having an expandable bladder confined within a fabric binder that can be wrapped around the limb and held in place by a hook and loop fastener or the like. Each cuff, such as cuff 1A in set 10*a*, has connecting tubes 14 and 15, one for introducing pressurized air and the other for exhausting or venting the cuff. The cuffs may all be of the same basic size and rely upon the adjustment afforded by the fastener, or they may be sized to locate each in a specific position in the array. The function of the apparatus of FIG. 1A is to squeeze the blood from both legs and both arms into the trunk center, i.e., the center of the circulation system of the body. The process of squeezing is like the squeezing of a flexible tube of toothpaste with the cap on. If you squeeze from the bottom of the tube, the balance of the tube will expand. This is analogous to what the apparatus of FIG. 1A achieves in the human body by squeezing the blood from the legs and the arms toward the center of the body.

The process of squeezing starts at the bottom of the left leg when cuff (belt) 1A closes and inflates, squeezing the leg and forcing the blood out of that section of the leg. With cuff 1A staying closed and inflated, belt 2A closes and inflates, squeezing the left leg and forcing the blood out of that section of the leg. This process continues until all seven belts 1A–7A have inflated in the left leg. Then the belts 1B–7B of the right leg are inflated, in the same sequence, starting with 1B and ending with 7B. Then each of the arms, in turn, are squeezed in the same sequence and manner as the legs. It is important for all the belts to remain closed and inflated so that no blood can return to the legs or arms so that maximum pressure is maintained in the balance of the body, i.e., the trunk and head, until the cycle is over. Preferably complete closure is maintained for at least 20 seconds and less than one minute.

Preferably the following procedure is used daily, for about one hour a day, for at least 4–6 weeks before beneficial results may be seen. It should be used continually, on a daily basis, in the same manner as daily exercise. An hour is sufficient time for about 20 complete cycles, preferably the user should receive in the range of 10 to 30 complete cycles each day. A chart showing the preferred procedure of a single cycle is as follows (the numbers as in seconds):

| | | | | | |
|---|---|---|---|---|---|
| 1. | left leg-20 | right leg-20 | left arm-20 | right arm-20 | hold and buttock-60 |
| 2. | right leg-20 | left arm-20 | right arm-20 | left leg-20 | hold and buttock-60 |
| 3. | left arm-20 | left leg-20 | right leg-20 | left arm-20 | hold and buttock-60 |
| 4. | right arm-20 | left leg-20 | right leg-20 | left arm-20 | hold and buttock-60 |

-continued

| | | | | |
|---|---|---|---|---|
| 5. | reverse left leg-20 | reverse right leg-20 | reverse left arm-20 | reverse right arm-20 |

The pressure is preferably 4–12 lbs/sq.in. The complete cycle above, consists of five sequence portions. In the first sequence 1, above, as shown in FIG. 1A, the cuffs 1A–7A are inflated in sequence starting with 1A and ending with 7A, which takes 20 seconds. The cuffs 1A–7A are then held inflated while the other three sets of cuffs are being inflated and during the "hold and buttock period". Consequently, in the first sequence the cuffs 1A–7A are held inflated, after being fully inflated, for 120 seconds. After the cuffs 1A–7A are fully inflated, the cuffs 1B and 7B are inflated in sequence, which takes 20 seconds. In this sequence the cuffs 1B–7B are held fully inflated for 100 seconds. Then cuffs 1C–7C are inflated, in sequence, and held fully inflated for 80 seconds. Then, the cuffs 1D to 7D are inflated, in sequence, and held fully inflated for 60 seconds. The four sets of cuffs 1A–7A, 1B–7B, 1C–7C, and 1D–7D are held fully inflated for 60 seconds during which second period the buttock bladder 8 is inflated and pulsed with air in 1–3 second bursts at 10–12 lbs/sq.in. (p.s.i.) pressure. At the end of the 60 seconds all the cuffs and the buttock bladder 8 are opened, releasing their air and deflating.

In sequence 5 above, the blood is forced to the limb extremities (hands and feet) to aid in blood circulation in those areas. For that purpose three cuffs are inflated in reverse peristaltic order, i.e., from the trunk toward the extremity. In sequence 5 above, the left leg cuffs are inflated in the order 7A to 5A and held for 20 seconds; the right leg cuffs are inflated in the order 7B to 5B and held for 20 seconds; the left arm cuffs are inflated in the order 7C to 5C and held inflated for 20 seconds and then the right arm cuffs are inflated in the order 7D to 5D and held inflated for 20 seconds. Each of the sets of cuffs is preferably deflated after the 20-second holding period, so that only one set is inflated at a time. Alternatively, the cuffs, during the reverse sequence, are held inflated while the other cuffs are being inflated. In this alternative, preferably the set of cuffs held inflated the longest are changed in order. For example, in sequence 10, not shown, the cuffs on the right leg are the first set of cuffs to be inflated in reverse order.

By analagy to the tube of toothpaste expanding because of the extra paste being squeezed from the bottom of the tube, the vascular system expands slightly because of the excess blood in the center of the body, i.e., trunk and head.

While the vessels are expanded, the circulatory system is still circulating blood through the vessels and the expansion of the vessels will loosen particles of cloggulation and allow blood to pass through areas of cloggulation. The capillaries are the first to expand slightly and then the veins because they are larger and their walls are thicker. The capillaries in the kidneys, liver, spleen, adrenal glands, lungs, skin and others are all affected by this slight expansion and contraction. It is important to hold the cycle in the closed position, keeping the vessels expanded for at least 20 seconds.

Each kidney, for example, may have over one million nephrons, each having "glomerulus" (a group of capillaries with a total surface area of about 15 square feet which are intertwined with the tubules). The nephrons and tubules together are called the nephrons. As the blood passes through these capillaries, the blood is filtered. The liver has 50,000 lobules, which are a group of vessels and cell formation which filter the blood as it passes through the liver. It is important for these vessels to be free-flowing and not subject to particles of cloggulation. The increased pressure to the trunk region of the body may aid in the blood circulation through these vessels and improve their functioning. The human body, it has been estimated, has 60,000 miles of blood vessels.

As shown in FIGS. 2–8, the apparatus includes a base member 100 having a seat portion 101 and a back rest 102. The base member has left and right channels 114, 115 (see FIG. 8) which receive the backs of the user's legs.

A top member 103 has two elongated leg channels 104, 105 which hold the front of the user's legs. Foot members 106, 107 are adjustably connected to the channels 104, 105, respectively, and are adapted to hold the user's feet. The top member 103 may be swung upwardly about hinge 108 or swung down and clamped on the base member 100, as shown in FIG. 1. A carriage 109 is slidingly mounted on the top member 103. The carriage carries left and right arm tubes 110, 111 through which the user's arms extend. The user operates the controls which are on the cross-bar 112 and views the status of the apparatus, by an alphanumeric display of pressure, timing, sequence, etc., which are displayed on display 113, preferably an LCD panel.

As shown in FIG. 8, the left and right leg channels in the base member and in the top member each have a series of inflatable bladders (cuffs) each of which are in a flat half-ring form prior to inflation. The bladders in the base leg channels are opposite the bladders in the top leg channels so that they form an effective circle (ring) about the leg. The bladders in the right leg base channel portion are bladders B2B; B3B through B6B; the bladders in the right leg top member channel are B2A through B6A; the base left leg channel bladders are A2A–A6A; the top member left leg channel bladders are A2B–A6B; and the buttock bladders on the seat portion are E1, E2. The bladders in the leg channels are connected by air pressure lines so that opposite bladders inflate simultaneously, for example, the air pressure lines are connected so that bladders B1B and B1A are simultaneously inflated.

The feet members 104, 105 are boot-like openable shell members. Each foot member has two oppositely arranged bladders B1B and B1A (right foot) and A1A and A1B (left foot).

The bladders C1–C4 within the right arm tube 111 and the bladders D1–D4 within the left arm tube 110 are each inflatable to become doughnut-shaped and encircle the arms of the user.

The system includes an air pump 120 which may provide 4–10 pounds per square inch of air pressure (psi); an air accumulator 121 (air tank), which is connected to manifold 122 having solenoid operated air pressure control valves 123 settable at 4–10 psi; a pressure sensor 124 connected, by an electrical line, to "I/O controller" 125, which preferably is a software programmable microcomputer. The controller 125 is connected to a solenoid card 126, which produces control pulses to the solenoid-operated air and vacuum valves; an input device 127, which, for example, is a keypad operable to set the timing and pressure; and a power supply, preferably a 110 AC to 12 volts DC converter.

A vacuum source 128, preferably a vacuum pump and tank, is connected to the manifold 129.

Each bladder has a connecting line (tube) and an air-vacuum valve, the valves being labeled SB1–SB6, SA1–SA6, SC1–SC4, SD1–SD4, SE1 and SE1. Each valve is a three-way solenoid valve connected to the manifold 129. Depending on the setting of the valve it is shut, opened to the air pressure, opened to vacuum (by operation of valve 130) or opened to atmosphere (by operation of vent solenoid valve 131).

In operation, the user sits down in the seat portion 101 and swings the top member 103 down onto the base member 100, where it automatically is locked by a releasable fastener. He then pulls the carriage 109 toward his chest and puts his arms through the arm tubes 110, 111. He then views the panel 113 and operates the controls on the cross-bar 112.

The user will operate the "On" button to energize the system, i.e., light up the display and start the air pump. For example, the display may display the following menu: "Select Sequence"; "Select Pressure"; "Select Number of Repetitions"; "Press Start To Begin"; "Press Stop To Abort". The user will operate a keypad on the display panel and select the sequences (modes); examples of which are given below. He may select one or more modes and mix them in any combination. He then selects the number of repetitions (cycles) in each mode.

He will then select the pressure, for example, 4, 6, 8 or 10 psi. If the user is under the guidance of another, for example, a trainer, then the selection of the exercise program will be by the trainer. In addition, the controller has a digital memory to record the program of each user, so the user need only enter his number and confirm that the same program should be repeated.

The user will then push the "start" button and the blood exercise program will commence.

A typical preferred sequence is as follows: Left foot and leg are squeezed in a peristaltic sequence A1A, A1B hold; A2A, A2B hold through A6A–A6B hold; right foot and leg in a similar peristaltic sequence B1A, B1B hold—B6A, B6B hold; right arm in a peristaltic sequence C1, hold, C2, hold . . . C4 hold; left arm in a similar peristaltic sequence D1, hold . . . D4, hold; buttocks, E1 hold, E2 hold for 1–2 seconds; then all bladders are simultaneously vented to atmosphere. In Sequence Two, the same program is followed except the order of squeezing the limbs is changed so that the order becomes right foot and leg; right arm; left arm; left foot and leg and buttocks. In Sequence Three, the order of squeezing, in a peristaltic motion on the limbs, is: right arm; left arm; left foot and leg; right foot and leg; buttocks. In Sequence Four the order is: left arm; left foot and arm; right foot and leg; right arm; and buttocks.

A post-therapy refresh cycle reverses the direction of the peristaltic motion so that the bladders nearest the trunk are inflated first. A typical order is left foot and leg (A6A, A6B purge; A2A, A2B purge; A4A, A4B purge); and then three sets of bladders for the right foot and leg (6A, B6B purge–B4A, B4B purge); right arm (C4 purge–C2 purge); left arm (D4 purge–D2 purge). At the end of this refresh cycle the valves are opened and the bladder air is released to atmosphere.

The user may then select to repeat the refresh cycle, initiate the massage program (described below) or terminate the exercise session.

In the massage cycle the bladders are operated in a peristaltic sequence, one after the other starting from those furthest from the trunk, as in the exercise sequences. However, the bladders are not kept inflated, i.e., not placed on "hold", after they are inflated. A massage cycle is as follows: left foot and leg (A1A, A1B, purge; A2A, A2B, purge through A6A, A6B purge); right foot and leg (B1A, B1B, purge-B6A, B6B, purge); right arm (C1, purge-C4, purge); left arm (D1, purge-D4, purge) and buttocks (E1, purge; E2, purge). The bladders (cells) are all deflated (vented to atmosphere). The user is then presented with the menu, on the display panel, permitting him to select to repeat the massage cycle, initiate the therapy program or terminate the session.

In an alternative exercise sequence the limbs are all simultaneously squeezed, in a peristaltic manner. In this sequence the limbs may be squeezed and held squeezed or alternatively each bladder may be vented after it has been inflated. In the first case, each limb is squeezed at the same time, for example, simultaneously the bladders A1A, A1B-A6A, A6B; B1A, B1A, B1B-B6A; B6B; C1-C4 and D1-D4 are inflated in the same sequence, i.e., A1A, A1B, B1A, B1B, C1 and D1 are inflated at the same time. Each bladder is held inflated until they are all inflated and then they are held inflated 1-20 seconds while bladders E1, E2 are inflated.

Alternatively, the same sequence is followed on all the limbs simultaneously, except that each bladder is deflated as soon as the next bladder in its series has been inflated, for example, C1 is inflated and then deflated as soon as C2 has been inflated. Bladders E1 and E2 are inflated when C4, C5 are inflated. Then all the bladders are deflated.

In an alternative blood exercise sequence, which is an optional sequence, there is a continuous milking of the blood from the limbs to maximize the blood flow to the trunk. For example, the bladders are inflated in a sequence in which the bladders furthest from the trunk are inflated, held inflated while the next bladder nearer the trunk is inflated, and then deflated. The limbs may be milked either in sequence or simultaneously. An example of this procedure in the right arm is as follows: inflate C1, hold; inflate C2, hold and deflate C1; inflate C3, hold and deflate C2; inflate C4, hold while this procedure is repeated and deflate C3; inflate C1, hold, etc.

In the prototype, shown in FIGS. 5-8, the corresponding parts are marked with an accent mark. Preferably the pumps, tanks and controller are within the base member 100, although alternatively they may be in a separate cabinet.

Having described the present invention with reference to the presently preferred embodiments thereof, it should be understood that various changes in construction and operation can be effected by those skilled in the subject are without departing from the true spirit of the invention as defined in the appended claims.

I claim:

1. Apparatus for the movement of blood as a vascular exercise program, including:

(a) a base member having a seat portion adapted to receive the buttocks of the user and two elongated leg channels adapted to receive the back portions of the user's legs;

(b) a top member having two elongated leg channels adapted to receive the front portions of the user's legs;

(c) clamp means operable to join the base and top members for a selected period of time to enclose the user's legs and then to release the base and top members;

(d) leg pressure applying means in said leg channels to selectively apply pressure to the user's legs in a peristaltic sequence;

(e) a pair of tubular arm members adapted to receive the user's arms; and (f) arm pressure applying means in said arm members to selectively apply pressure to the user's arms in a peristaltic sequence;

(g) wherein said arm members are mounted on said top member.

2. Apparatus as in claim 1 wherein said top member includes a rigid shell.

3. Apparatus according to claim 1 wherein each of said leg and arm pressure applying means comprise a plurality of inflatable bladders.

4. Apparatus according to claim 3, wherein each of said pressure applying means consist of at least four of said bladders adapted to be applied to each limb.

5. Apparatus according to claim 1 wherein said pressure applying means each comprises a plurality of inflatable bladder pressure cuffs and actuating means, said actuating means comprising for each said pressure cuff a separate solenoid controlled pressurizing valve and a separate solenoid controlled venting valve coupled to a respective inlet and outlet of said pressure cuff, a pressure regulated source of pressurized air coupled to all of said pressurizing valves, a vacuum container coupled to all of said venting valves, and program means for actuating said valves in a controlled sequence.

6. Apparatus according to claim 1 and further including pressure applying means positioned on said seat portion, to selectively apply pressure to the user'buttocks.

7. Apparatus according to claim 6, wherein said seat pressure applying means is an air bladder, and further including means to pulse the bladder of said seat pressure applying means with bursts of air pressure.

8. Apparatus as in claim 1 and further including two foot holding means on said base member proximate the end of said base leg channels to hold the user's feet.

9. Apparatus as in claim 8 wherein said clamp means includes a hinge proximate the foot holding means joining said top member and said base member.

10. Apparatus as in claim 8 wherein each of said foot holding means includes an inflatable bladder to selectively apply pressure to the user's feet.

11. Apparatus as in claim 8 wherein said foot holding means are each slidably mounted on said base member to adjust for the length of the user's legs.

12. Apparatus as in claim 1 wherein said arm members are mounted on a carriage which is slidably mounted on said top member.

13. Apparatus as in claim 12 and further including a bar extending perpendicular to the direction of sliding motion, positioned proximate the open ends of the arm members and adapted to be held by the user's hands while the user's arms extend within the arm members.

14. Apparatus for the exercise of user's vascular system by selectively moving blood from the limbs, including:

(a) a base member adapted to rest on a floor and having a seat portion configured to receive user's buttocks;

(b) two elongated leg channels on the base member adapted to receive the back portion of user's legs;

(c) a top member having a rigid shell and two elongated leg channels adapted to receive user's back leg portions;

(d) a plurality of inflatable elongated bladder means mounted in each of said leg channels to apply pressure to the legs in a predetermined sequence and to be inflated to hold pressure on the legs for a predetermined time period;

(e) clamp means to removably join the base and top members;

(f) a pair of tubular arm members, each having a rigid tubular shell;

(g) a plurality of doughnut-shaped inflatable bladder means within each tubular shell to apply peristaltic pressure to the arms and to be inflated to hold pressure on the arms for a predetermined time period;

(h) pressure control means comprising a vacuum source, a pressure source including an air pump, a microcomputer based control system, and air lines and vacuum lines connecting each of said bladders to the pressure source and vacuum source respectively;

(i) wherein the arm members are mounted on a carriage, the carriage being slidingly mounted on the top member.

15. Apparatus as in claim 14 and further including an inflatable bladder mounted on the seat portion and connected to the pressure source and vacuum source.

16. Apparatus as in claim 14 and further including, associated with each bladder, a solenoid controlled pressure valve connected to an air line and a solenoid controlled vacuum valve connected to a vacuum line.

17. Apparatus as in claim 14 and further including two foot holding means on said base member proximate the end of said base leg channels to hold the user's feet.

18. Apparatus as in claim 17 wherein each of said foot holding means includes an inflatable bladder to selectly apply pressure to the user's feet.

19. Apparatus as in claim 17 wherein said clamp means includes a hinge proximate the foot holding means joining said top member and said base member.

20. Apparatus as in claim 17 wherein said foot holding means are each slidably mounted on said base member to adjust for the length of the user's legs.

21. Apparatus as in claim 14 and further including a bar extending perpendicular to the direction of sliding motion, positioned proximate the open ends of the arm members and adapted to be held by the user's hands while the user's arms extend within the arm members.

* * * * *